US008191189B1

(12) United States Patent
Spell

(10) Patent No.: US 8,191,189 B1
(45) Date of Patent: Jun. 5, 2012

(54) INFANT SWADDLING AND SLEEP SACKS AND METHODS OF USING THE SAME

(75) Inventor: Leigh Anne Schaefer Spell, Beaumont, TX (US)

(73) Assignee: Leigh Anne Spell, Baytown, TX (US)

( * ) Notice: Subject to any disclaimer, the term of this patent is extended or adjusted under 35 U.S.C. 154(b) by 0 days.

(21) Appl. No.: 12/205,535

(22) Filed: Sep. 5, 2008

Related U.S. Application Data

(60) Provisional application No. 60/970,033, filed on Sep. 5, 2007.

(51) Int. Cl.
*A47G 9/08* (2006.01)

(52) U.S. Cl. ..... 5/494; 5/655

(58) Field of Classification Search ..... 5/655, 494, 5/413 R, 482; 2/69, 69.5
See application file for complete search history.

(56) References Cited

U.S. PATENT DOCUMENTS

| | | | | | |
|---|---|---|---|---|---|
| 4,125,903 | A * | 11/1978 | Farrell | 2/69.5 |
| D269,475 | S * | 6/1983 | Albertson | D2/719 |
| 5,046,204 | A * | 9/1991 | Mohler | 5/413 R |
| D405,635 | S * | 2/1999 | Cohen et al. | D6/603 |
| 7,181,789 | B2 * | 2/2007 | Gatten | 5/494 |

* cited by examiner

*Primary Examiner* — Frederick Conley

(57) ABSTRACT

In general, various embodiments of the present invention disclose swaddling implements and/or blankets that immobilize an infant's arms while placing gentle, even pressure on the torso, restricting leg movement without excessive pressure, and leaving the infant's head unencumbered.

17 Claims, 5 Drawing Sheets

INFANT SWADDLING AND SLEEP SACKS AND METHODS OF USING THE SAME

RELATED APPLICATION

This application claims priority to U.S. provisional patent application 60/970,033, titled "A fabric alternative to traditional infant swaddling and sleep sacks" filed on Sep. 5, 2007.

BACKGROUND OF THE INVENTION

The swaddling of infants has been practiced by people around the world for a variety of reasons, including, but not limited to, protecting an infant from the surrounding environment, allowing a caregiver to handle and carry an infant more easily, and comforting and/or quieting an infant.

There is some evidence that this is especially true of sick or "colicky" infants. Although no specific cause for colic has been identified and many potential remedies have been offered, research has shown that effective swaddling has a calming effect on crying infants. Other research also shows that a swaddled infant tends to be more willing to sleep on her back, which significantly reduces vulnerability to Sudden Infant Death Syndrome ("SIDS").

Typically, a swaddling implement provides a means for immobilizing an infant's arms while placing gentle, even pressure on the torso. Further, a swaddling implement would restrict leg movement without excessive pressure and would leave the infant's head unencumbered. Other features common in swaddling implements include material of construction, shape and length of wrap.

Unfortunately, presently-available swaddling implements do not provide all of these features. Quite often wraps associated with swaddling implements or blankets are wrapped too tightly around the infant, thereby either choking the infant, making the infant uncomfortable, and/or the like. As well, as an infant matures and gains strength, the infant is often able to unwrap blankets of fabric in traditional swaddling implements often creating a choking hazard.

Accordingly, the art field is in search of a swaddling implement or blanket that provides one or more of the desirable features mentioned above without the drawbacks of traditional wrap type swaddling implements and/or blankets.

SUMMARY

Various embodiments of the present invention provide a secure and contained environment for an infant while sleeping that mimics the effects of swaddling without the wrapping of fabric, tucking of fabric and without the use of VELCRO (available from Velcro USA Inc., 406 Brown Avenue Manchester, N.H. 03103), snaps, and/or other fastening devices. An infant's arms are optionally kept inside the swaddling implement by use of a downward pocket positioned at least partially circumferentially around an outer edge of preventing an infant from extending their arms out the top of the swaddling implement and/or blanket. Accordingly, various embodiments of the present invention enhance known swaddling implements, providing an easy-to-use swaddling blanket that at least partially immobilizes an infant's arms while placing gentle, even pressure on the torso, restricting leg movement without excessive pressure, and leaving the infant's head unencumbered.

In an embodiment, the implement is made of two pieces of fabric sewn together in a specific shape that contours an infant's body. The two pieces of fabric are folded at the top of the device and sewn in such a way that the fold creates a pocket all the way around the top of the device. The device slides up an infant fitting snuggly across the infant's shoulders. The pocket at the top opening of the device prevents infants from extending their hands out of the implement. As an infant slides their arms towards the top of the device the infant's arms push against the interior of the swaddling implement and slides between the two pieces of fabric keeping their hands and/or arms from escaping the swaddling implement.

Various embodiments of the present invention comprise a swaddling implement comprising at least one body panel comprising a width, a first top edge having a length at least about seventy-five (about 75%) percent of the length of said width, a first bottom edge having a length less than the length of said first top edge, and a first side edge having a length at least about 150% of the length of said width, and a downward pocket positioned downward from said first top edge in an at least partial circumferential manner within said at least one body panel, wherein said at least one body panel is capable of swaddling an infant and said downward pocket prevents said infant from extending their arms outside of said swaddling implement.

Further embodiments comprise a swaddling implement, comprising: at least one body panel having a first top edge, a first side edge, a width, and a first bottom edge, wherein said first side edge tapers from said width to both said first top edge and said first bottom edge, and a downward pocket positioned downward from said first top edge in an at least partial circumferential manner within said at least one body panel, wherein said at least one body panel is capable of swaddling an infant and said downward pocket prevents said infant from extending their arms outside of said swaddling implement.

Yet further embodiments comprise a swaddling implement comprising as bag of unitary construction, with one body pouch and at least one downward pocket, the body pouch generally shaped in an irregular tube shape with a large opening and a small opening, the body pouch being generally tapered outwardly from the large opening to a width and the body pouch generally tapered inwardly from the width to the small opening.

Further embodiments comprise methods of use for the various embodiments of swaddling implements.

BRIEF DESCRIPTION OF THE FIGURES

In order that the manner in which the above recited and other advantages and objects of the invention are obtained, a more particular description of the invention briefly described above will be rendered by reference to specific embodiments thereof, which are illustrated, in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION

Figure 1:
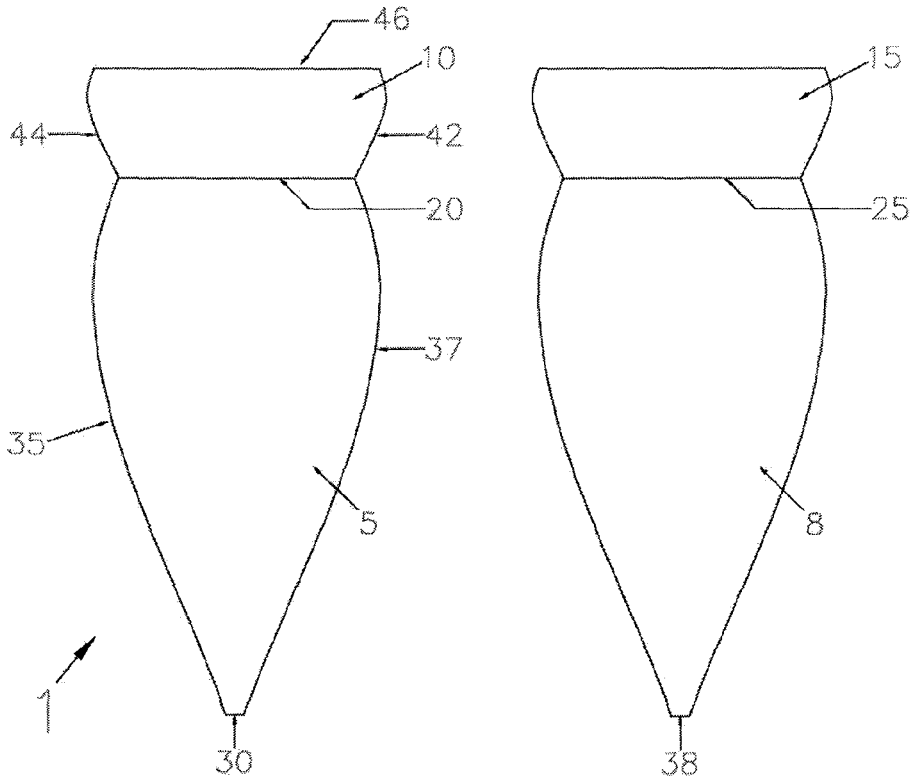
FIG. 1 is an illustration of two pieces of fabric capable of being formed into an embodiment of the present invention.

The following definitions and explanations are meant and intended to be controlling in any future construction unless clearly and unambiguously modified in the following Description or when application of the meaning renders any construction meaningless or essentially meaningless. In cases where the construction of the term would render it meaningless or essentially meaningless, the definition should be taken from Webster's Dictionary, 3rd Edition. Definitions and/or interpretations should not be incorporated from other patent applications, patents, or publications, related or not, unless specifically stated in this specification or if the incorporation is necessary for maintaining validity.

As used herein, the term "swaddling" means and refers to a practice of wrapping infants snugly in swaddling cloths, blankets or similar cloth so that movement of the limbs is restricted. Swaddling bands were often used to further restrict the infant.

Other than in the operating examples, or where otherwise indicated, all numbers expressing quantities of components used herein are to be understood as modified in all instances by the term "about".

In general, various embodiments of the present invention relate to swaddling implements that are capable of being used to swaddle an infant. In various embodiments, a swaddling implement of the present invention also functions as a sleeping bag or blanket. A general shape of an assembled embodiment of a swaddling implement of the present invention can be defined as bag of unitary construction with no zipper, no hook and loop fastener, no snaps, no VELCRO, no buttons, and/or the like, with one body pouch and at least one downward pocket, the body pouch generally shaped in an irregular tube shape with a large opening and a small opening, the body pouch being generally tapered outwardly from the large opening to a width and the body pouch generally tapered inwardly from the width to the small opening. In various embodiments, the large opening and the small opening are the same size. In various alternate embodiments, the small opening is closed.

In various embodiments, the irregular tube shape allows room for an infant's arms and/or trunk about the width/enlarged portion of the irregular shaped tube.

In an alternate embodiment, a description of an embodiment of a swaddling implement is capable of being described as at least one sheet of material that is capable of being processed or formed into an embodiment of a swaddling implement of the present invention. In an embodiment, a swaddling implement of the present invention comprises at least one body panel comprising a width, a first top edge having a length at least about seventy-five (about 75%) percent of the length of the width, a first bottom edge having a length less than the length of the first top edge, and a first side edge having a length at least about 150% of the length of the width, and a downward pocket positioned downward from the first top edge in an at least partial circumferential manner within the at least one body panel, wherein the at least one body panel is capable of swaddling an infant and the downward pocket prevents the infant from extending their arms outside of the swaddling implement.

In an alternate embodiment, a swaddling implement comprises at least one body panel having a first top edge, a first side edge, a width, and a first bottom edge, wherein the first side edge tapers from the width to both the first top edge and the first bottom edge, and a downward pocket positioned downward from the first top edge in an at least partial circumferential manner within the at least one body panel, wherein the at least one body panel is capable of swaddling an infant and the downward pocket prevents the infant from extending their arms outside of the swaddling implement.

In various embodiments, the downward pocket is formed by folding at least a portion of said body pouch within said swaddling implement and attaching said pocket to said body panel such that an at least partial circumferential downward pocket is formed.

Embodiments of the present invention are capable of fitting about an infant and swaddling the infant without the use of wraps or other blankets and the downward pockets prevent the infant's hands and/or arms from being extended outside of the swaddling implement. In various embodiments, no zipper, hook and loop fastener, snaps, VELCRO, buttons, and/or the like are required to secure the infant inside the swaddling implement.

In various embodiments, multiple panels are used and secured together to form an embodiment of the present invention, such as by sewing, stitching, melting, tieing, and/or the like.

In further embodiments, the lengths of the sides can be varied according to desired process considerations such as the size of the infant, and/or the like. In an embodiment, the length of the first side edge is at least about 250% of the length of the width. In an embodiment, the length of the top edge is at least about 50% of the length of the width. In an alternate embodiment, the length of the first side edge is at least about 350% of the length of the width. In an embodiment, the length of the top edge is at least about 25% of the length of the width.

In various embodiments, the length of at least one body panel of the swaddling implement from about the width to the bottom edge is in excess, such that the swaddling implement is longer than the infant. A knot or other method of securing the excess swaddling implement is capable of being used to adjust the length of the swaddling implement to the length of the infant.

In various embodiments, the lengths of the various edges can vary as would be apparent by one of ordinary skill in the art.

Various embodiments of the present invention can be formed from generally any material. Suitable materials include, but are not limited to, fabrics, such as cotton flannel, SPANDEX®, polyester, cotton/polyester blend, ribbed cotton, elastic cotton, cotton waffle, viscose georgette, polyester georgette, rayon, satin, cotton voil, terry voil, cotton crepe, rayon crepe, shantoon, flex, linen, poplin, cambric, sheeting, denim, silk denim, knits, cotton check, cotton crepe check, silk, terry cloth, and cotton interwoven with sterling silver thread. Many other fabrics known in the art may be used instead or in addition, depending on the desired characteristics such as elasticity, warmth, weight, breathability, stain resistance, absence of allergens, visual appeal, and other factors. The present invention may be made of a single material or parts may be made of different materials. Flexible, non-fabric materials may also be used to provide special characteristics.

Various embodiments of the present invention further comprise methods for swaddling an infant comprising the steps of sliding the implement, as herein described, up the infant from the infant's feet to the infant's arms, and placing each arm inside the downward pocket. Further embodiments comprise a method for treating colic comprising the step of swaddling an infant with the swaddling implement as herein described. Further embodiments disclose a method for recreating the environment of the womb comprising the step of swaddling an infant with the swaddling implement as herein described.

A number of embodiments of the invention have been described. Nevertheless, it will be understood that various modifications may be made without departing from the spirit and scope of the invention. For example, the swaddling blanket may comprise a generally rectangular or rhomboidal shape and function as described herein. Accordingly, other embodiments are within the scope of the following claims.

EXAMPLES

In general, embodiments of the present invention are comprised of 2 pieces of fabric ranging from 12-48 inches in length and 0-36 inches in width sewn together in such a way that the fabric creates a pocket 2-12 inches deep at the opening of the device. The fabric eventually coming to a point at the bottom that can be tied in a knot to adjust the length of the device to fit the infant. The 2 pieces of fabric are sewn together creating a pod like environment that mimics the effects of swaddling.

In an embodiment, once constructed, the device is used on an infant by sliding the device gently up the infant and gently placing each arm inside the device making sure that it is securely below the level of the pocket. Once the child is snuggly inside the device tie a knot at the base below the level of the infant's feet to adjust the length. It can be made out of one piece of fabric, with large or small pockets. The dimensions can also vary several inches.

Now referring to FIG. 1, an embodiment of a swaddling implement 1 of the present invention is disclosed. In this embodiment, two pieces of material are cut into shapes that are capable of being sewn together to form a swaddling implement of the present invention. In general, a swaddling implement of the present invention comprises a body panel 5, a pocket 10, a top edge 20, a pocket edge 44, a first side edge 35, and a bottom edge 30. Further embodiment may comprise an opposing first side edge 37, an opposing pocket edge 42.

In this embodiment, the second body panel 8 comprises a top edge 25, a pocket 15, and a bottom edge 38.

To form a swaddling implement 1, body panel 5 and body panel 8 are sewn together along the side edges up to the top edge. Pocket 10 and pocket 15 are folded along the respective top edge inside the swaddling implement and sewn or stitched at least partially along the seam or edge to form a pocket. Bottom edge 30 and/or bottom edge 35 can be sewn closed or left open as desired.

Figure 2:
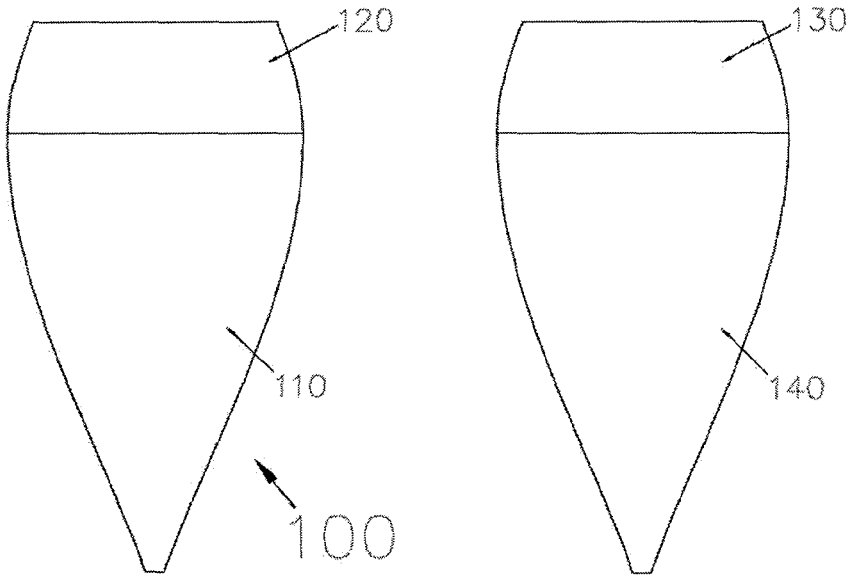
FIG. 2 is an illustration of a partially assembled embodiment of the present invention.

Now referring to FIG. 2, an illustration of a swaddling implement 100 is disclosed wherein pocket 120 and pocket 130 are sewn into place prior to or at the same time as 110 and 140 to body panel 110 and body panel 140 together.

Figure 3:
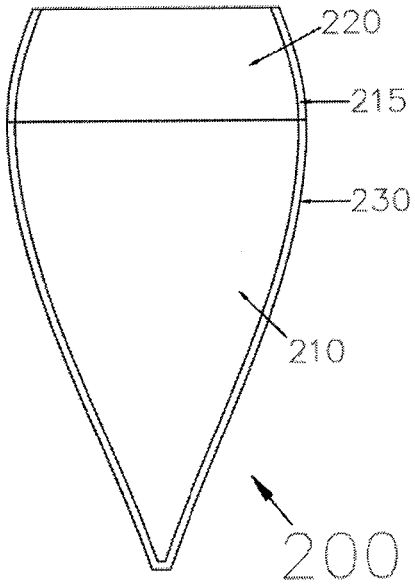
FIG. 3 is an illustration of a reversed embodiment of the present invention.

Now referring to FIG. 3, an illustration of an inverted swaddling implement is disclosed wherein a seam 230 has been used to form a swaddling implement of the present invention.

Figure 4:
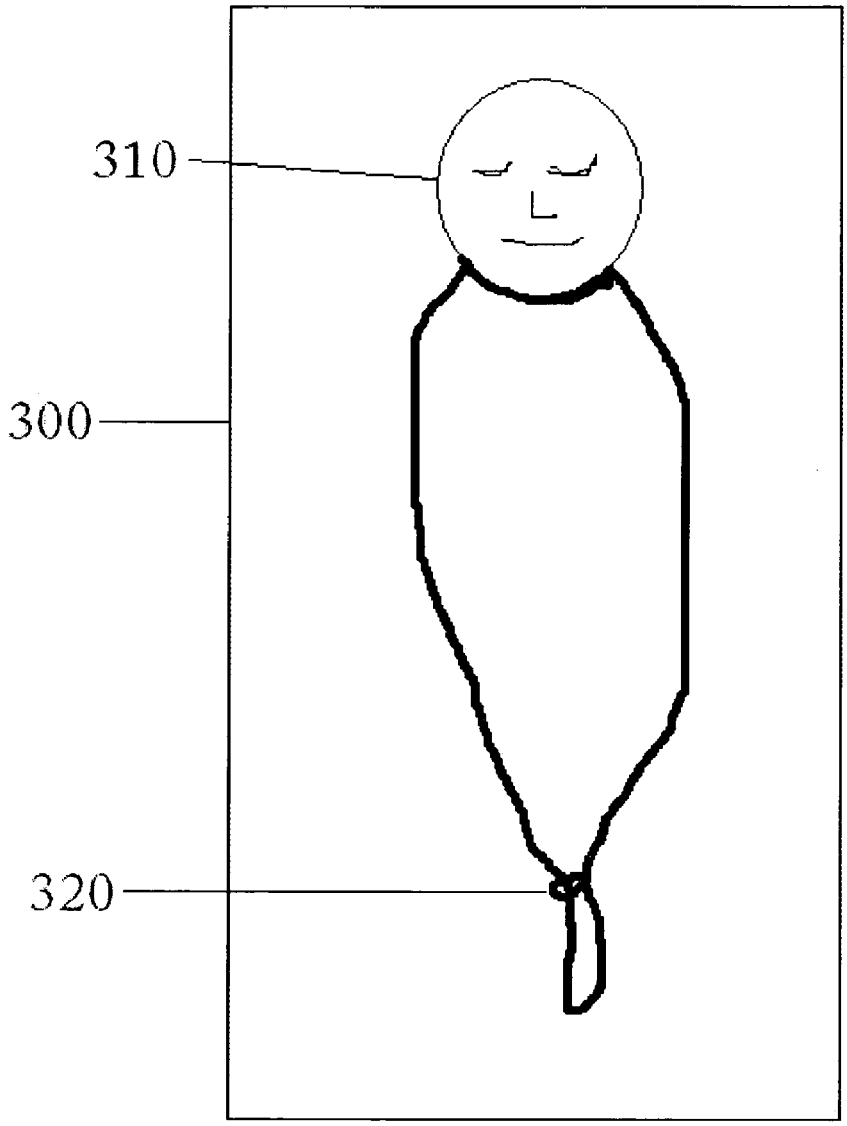
FIG. 4 is a photo of an infant inserted in an embodiment of the present invention.

Now referring to FIG. 4, a reproduction of a photograph is illustrated wherein an infant 310 is being swaddled within a swaddling implement 300 of the present invention. Also visible is a knot 320 for securing excess fabric from swaddling implement 300.

Figure 5:
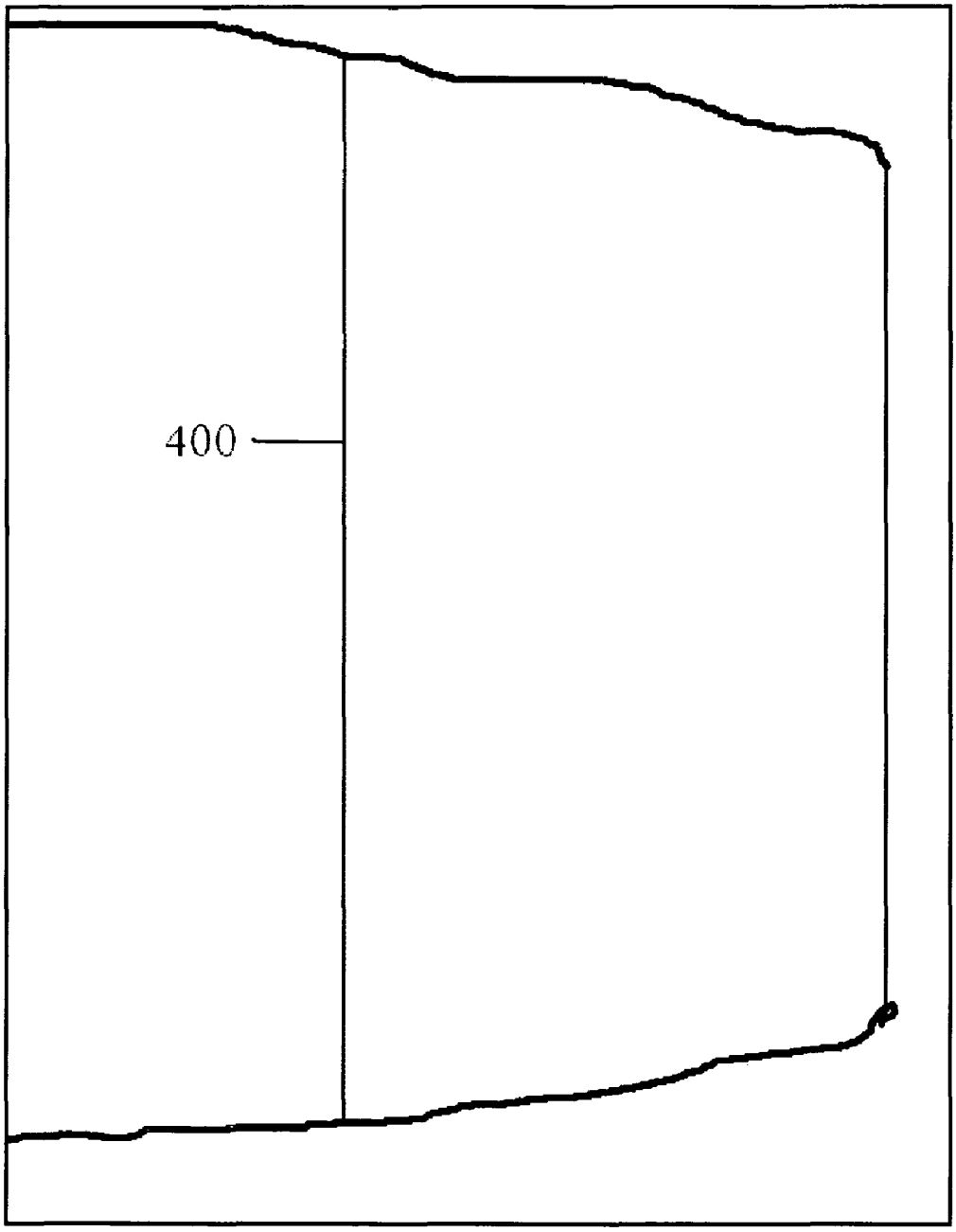
FIG. 5 is a photo of a reversed embodiment of the present invention.

Now referring to FIG. 5, a reproduction of a photograph of an embodiment of a swaddling implement 400 illustrating a lined pocket is disclosed.

What is claimed is:

1. A swaddling implement comprising:

at least one unitary body panel in a tubular shape to circumferentially surround an infant comprising and defined by a maximum width, a straight first top edge that circumferentially surrounds the infant below the level of the head having a length at least seventy-five (75%) percent of the length of said maximum width, a first bottom edge having a length less than the length of said first top edge, and a first side edge that tapers slightly out to said maximum width and then tapers in having a length at least 150% of the length of said maximum width and a second side edge that tapers slightly out to said maximum width and then tapers in having a length at least 150% of the length of the said maximum width that are permanently secured together to form a circumferential tubular shape, and a pocket panel defining a downward circumferential pocket opening downward from said first top edge, where the bottom edge of the downward circumferential pocket maintains a similar distance from the straight first top edge of the swaddling device secured on the interior of the device within said body panel such that the distance from the top edge to the bottom edge of the downward circumferential pocket is contained within the interior section of the circumferential tubular body panel of said swaddling device, wherein said body panel is open along a portion of said first top circumferential edge for receiving an infant and further wherein said body panel is capable of swaddling an infant by the structural placement of the tubular shaped circumferential body panel with circumferential downward pocket below the level of the head of said infant where said downward circumferential pocket receives the infants arms if said infant pushes said arms upwards toward the open first top circumferential edge where the infant's body is received into the device. Said downward circumferential pocket thus receives said infant's arms preventing said infant from extending said arms out the open portion along said first top circumferential edge of the swaddling implement capable of receiving said infant.

2. The swaddling implement of claim 1, comprising no zipper, no hook and loop fastener, no snaps, no buttons, no drawstrings, no head covering, and no wrapping of fabric around body, arms and torso of infant.

3. The swaddling implement of claim 1, wherein said at least one body panel comprises a double fabric.

4. The swaddling implement of claim 1, wherein said at least one body panel comprises at least two body panels that are stitched together.

5. The swaddling implement of claim 1, wherein said at least one body panel comprises a stretchable fabric.

6. The swaddling implement of claim 1, wherein said at least one body panel comprises a fabric for warmth.

7. The swaddling implement of claim 1, wherein said first side edge has a length of at least 250% of the length of said width.

8. A method for swaddling an infant comprising the steps of sliding said implement of claim 1 up the infant from said infant's feet to said infant's arms, and placing each arm inside or below the level of said downward pocket where said downward pocket is located at the level of the shoulders.

9. The method of claim 8, further comprising the step of fitting said infant in said swaddling implement.

10. A method for treating colic comprising the step of swaddling an infant with said swaddling implement of claim 1.

11. A method for recreating the environment of the womb comprising the step of swaddling an infant with said swaddling implement of claim 1.

12. The swaddling implement of claim 1, wherein the length of said pocket is at least 75% of said first top edge.

13. A swaddling implement of claim 1, wherein said circumferential downward pocket panel could be modified to be partially circumferential only if the distance from the top edge to the bottom edge of said downward pocket were located in the interior of the circumferential device on the front of the unitary tubular body panel of said swaddling implement going across the front of the infant's torso below the level of the head.

14. A swaddling implement comprising a bag of unitary construction with no zipper, no hook and loop fastener, no snaps, no buttons, and/or the like, no draw strings, no head covering, and no fabric to be wrapped around said infant's torso with one body pouch, secured side edges, and at least one circumferential pocket panel defining a downward pocket secured on the interior of the device, where the bottom edge runs a similar distance to the top and the distance from the first top edge to the bottom edge is located below the level of the head within the body pouch, the body pouch generally shaped in an irregular tube shape with a large opening and a small opening, the body pouch being generally tapered outwardly from the large opening to a width and the body pouch generally tapered inwardly from the width to the small opening.

15. The swaddling implement of claim 14, wherein the downward pocket is formed by folding at least a portion of said body pouch within said swaddling implement and attaching said pocket to said body panel such that an at least partial circumferential downward pocket is formed.

16. The swaddling implement of claim 14, wherein the downward pocket is downward facing from the large opening.

17. A swaddling implement, comprising: at least one unitary body panel in a tubular shape to circumferentially surround an infant comprising and defined by a first top edge below the level of an infant's head, a first side edge, a second side edge permanently secured to said first side edge, a width, and a first bottom edge, wherein said first side edge tapers from said width to both said first top edge and said first bottom edge, and a circumferential pocket panel defining a downward pocket positioned downward from said first top edge in a circumferential manner where the bottom edge runs a similar distance to the top and the distance from the first top edge to the bottom edge is secured on the interior of the device within said at least one circumferential body panel below the level of the infant's head, wherein said at least one body panel is capable of swaddling an infant and said downward pocket prevents said infant from extending their arms outside of said swaddling implement.

* * * * *